US006633136B2

(12) United States Patent
Kim et al.

(10) Patent No.: US 6,633,136 B2
(45) Date of Patent: Oct. 14, 2003

(54) CURRENT CONTROL CIRCUIT FOR DISPLAY DEVICE OF PASSIVE MATRIX TYPE

(75) Inventors: Hak Su Kim, Kyonggi-do (KR); Young Sun Na, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/911,877

(22) Filed: Jul. 25, 2001

(65) Prior Publication Data

US 2002/0060524 A1 May 23, 2002

(30) Foreign Application Priority Data

Jul. 26, 2000 (KR) ..... 2000-43190

(51) Int. Cl.[7] ..... G09G 3/10
(52) U.S. Cl. ..... 315/169.3; 345/76; 345/204
(58) Field of Search ..... 315/169.1, 169.2, 315/169.3, 169.4, 291, 302, 307, 315; 345/55, 76, 82, 211, 204

(56) References Cited

U.S. PATENT DOCUMENTS 4,199,733 A * 4/1980 Schade, Jr. ..... 330/277
5,283,537 A * 2/1994 Nakamura ..... 330/288
5,349,595 A * 9/1994 Ogawa et al. ..... 372/38
5,631,547 A * 5/1997 Fujioka et al. ..... 323/273
5,747,850 A 5/1998 Mei ..... 257/328
5,854,566 A * 12/1998 Kwon et al. ..... 327/403
5,966,110 A 10/1999 Van Zalinge ..... 345/82
6,091,203 A * 7/2000 Kawashima et al. ..... 315/169.3
6,194,955 B1 * 2/2001 Ishida ..... 327/538

FOREIGN PATENT DOCUMENTS

EP 0 365 445 4/1990 ..... G09G/3/32
WO WO 99/65012 12/1999 ..... G09G/3/30

* cited by examiner

*Primary Examiner*—Hoang Nguyen
(74) *Attorney, Agent, or Firm*—Fleshner & Kim, LLP

(57) ABSTRACT

A current control circuit for a display device is disclosed. The current control circuit for a display device includes a current mirror circuit consisted of high voltage electronic devices, for outputting current equivalent to a power source voltage to a load, a current set unit connected with the current mirror circuit, for setting a value of the current flowing in the load, and a switching element connected with the current mirror circuit, for switching the operation of the current set unit through an external control signal. An amount of the current applied to the load can accurately be controlled due to nonlinear characteristic of the high voltage devices.

23 Claims, 3 Drawing Sheets

CURRENT CONTROL CIRCUIT FOR DISPLAY DEVICE OF PASSIVE MATRIX TYPE

BACKGROUND OF THE INVENTION

1. Field of the Invention

The present invention relates to a current control circuit for a display device, and more particularly, to a passive type current control circuit based on high voltage devices.

2. Background of the Related Art

Recently, a flat display market is rapidly developing.

A flat display, developed beginning with liquid crystal displays (LCD), has received much attention. A cathode ray tube (CRT), which had been generally used in the field of display for several decades, is recently being replaced with flat displays such as Plasma Display panel (PDP), Visual Fluorescent Display (VFD), Field Emission Display (FED), Light Emitting Diode (LED), and Electro-luminescence (EL).

Recently, there are two methods for driving display devices. The one is a passive type driving method for use in a simple matrix. The other is an active type driving method for use in a thin film transistor (TFT)-LCD. The active type driving method is a voltage driving type and is mainly used in the PDP and the VFD. The passive type driving method is a current driving type and is mainly used in the FED, the LED and the EL device.

A display device of the simple matrix type is driven in a scan mode. However, since the display device has a limited scanning turn on time, a high voltage is required to obtain desired Luminance.

Meanwhile, the TFT-LCD includes a liquid crystal panel consisting of a plurality of gate lines, a plurality of data lines, and a plurality of pixels arranged in crossing points between the gate lines and the data lines. A driving circuit for the TFT-LCD applies display signals to the liquid crystal panel so that each pixel emits light.

Each pixel includes a TFT having a corresponding gate line (or scan line) connected with a corresponding data line, and a storage capacitor and a display device connected with a source of the TFT in parallel.

A related art passive type driving circuit will be described with reference to the accompanying drawings.

FIG. 1 is a diagram illustrating a related art passive type current driving circuit.

Referring to FIG. 1, an amount of current flowing in a load is controlled using current to voltage (I-V) characteristic of a p type FET Qp1.

To control current to voltage (I-V) characteristic of the P type FET Qp1, an amount of a voltage applied to a gate of the P type FET Qp1 is controlled using resistance to voltage (R-V) characteristic of an N type FET Qs which is a switching element. Maximum current iL that may flow in the load is also controlled.

However, the circuit of FIG. 1 depends on the P type transistor Qp1 and the N type transistor Qs to control the current flowing in the load. Accordingly, there is difficulty in exactly implementing the current control circuit. As an example, if there is any deviation in manufacturing the current control circuit in an integrated circuit type, a problem arises in that there are no solutions to solve the deviation.

In other words, when the integrated circuit is manufactured, a threshold voltage and an effective channel length of the P type transistor Qp1 and the N type transistor Qs may be varied depending on the process change and the location of a wafer. In this case, the current control circuit cannot exactly be implemented.

FIG. 2 is a circuit for compensating the deviation that may occur in an example of FIG. 1. As shown in FIG. 2, a current mirror circuit based on two high voltage devices is used as an element of the current control circuit.

Referring to FIG. 2, the current control circuit includes first and second PMOS transistors Qp1 and Qp2 having a power source voltage $V_{dd}$ as an input signal and constituting a current mirror 1, a load 2 connected with a drain of the first PMOS transistor Qp1, a variable resistor VR connected between the first PMOS transistor Qp1 and the load 2, and an NMOS transistor Qs connected with a drain of the second PMOS transistor Qp2 and acted as a switching element.

The operation of the current control circuit of the related art flat display device will be described with reference to FIG. 2.

Referring to FIG. 2, the first PMOS transistor Qp1 and the second PMOS transistor Qp2 have the same characteristic as each other.

Meanwhile, the current iL flowing in the load 2 is controlled by the variable resistor VR connected with the first PMOS transistor Qp1.

In other words, when the variable resistor VR is varied to a high resistance value, the current iL flowing in the load 2 becomes smaller. When the variable resistor VR is varied to a low resistance value, the current iL flowing in the load 2 becomes greater.

The current iL flowing in the load 2 can be expressed as follows.

$$i_L = \frac{V_{dd} - V_s - V_{dss}}{R_i} \tag{1}$$

In the above equation (1), Vdd is a power source voltage, $V_{agp}$ is a voltage drop between a source and a gate of a PMOS transitor, and $V_{dss}$ is a voltage difference between a drain and a source of an NMOS transistor.

As described above, the NMOS transistor Qs is used as a switching element and is controlled by an externally input signal $C_{on}$.

The aforementioned passive type current control circuit has several problems.

The current mirror circuit of the current control circuit includes high voltage devices. The high voltage devices have a nonlinear period in, the current to voltage (I-V) characteristic.

Moreover, a problem may occur in the characteristic of the current control circuit due to turn-on and turn-off characteristics of the high voltage device when a low current period is set or the high voltage devices are turned off.

In other words, when the high voltage devices include the first PMOS transistor Qp1 and the second PMOS transistor Qp2, the NMOS transistor Qc for switching should be provided with the high voltage device. At this time, a voltage of a current set terminal corresponding to the NMOS transistor Qc for switching should properly be controlled to resist a predetermined high voltage.

SUMMARY OF THE INVENTION

Accordingly, the present invention is directed to a current control circuit for a display device that substantially obviates one or more problems due to limitations and disadvantages of the related art.

An object of the present invention is to provide a control circuit for a display device that can solve problems due to process error when the display device is manufactured.

Another object of the present invention is to provide a current control circuit for a display device that can accurately control current flowing in a load considering nonlinear characteristic of a high voltage device.

Another object of the present invention is to provide a current control circuit for a display device, having a mirror structure with high voltage devices.

Other object of the present invention is to provide a current control circuit for a display device that can prevent leakage current from flowing in a load.

Additional advantages, objects, and features of the invention will be set forth in part in the description which follow and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, a current control circuit for a display device includes a current mirror circuit consisted of high voltage electronic devices, for outputting current equivalent to a power source voltage to a load, a current set unit connected with the current mirror circuit, for setting a value of the current flowing in the load, and a switching element connected with the current mirror circuit, for switching the operation of the current set unit through an external control signal.

Preferably, the current mirror circuit includes a first PMOS transistor having a first source connected with a power source voltage, a first drain, and a first gate, and a second PMOS transistor having a second source connected with the power source voltage, a second drain connected with the load, and a second gate connected with the first gate.

Preferably, the current control circuit further includes an element for preventing leakage current between the power source voltage and the gates to cut off the leakage current flowing in the load.

Preferably, the current control circuit further includes a level shifter for switching the element for preventing leakage current through the control signal for the switching element.

In the preferred embodiment of the present invention, the current control circuit is provided with the current mirror circuit based on high voltage devices, so that current applied to the display device can accurately be controlled.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

A current control circuit based on high voltage devices according to the first embodiment of the present invention will be described with reference to FIG. 3.

Figure 1:
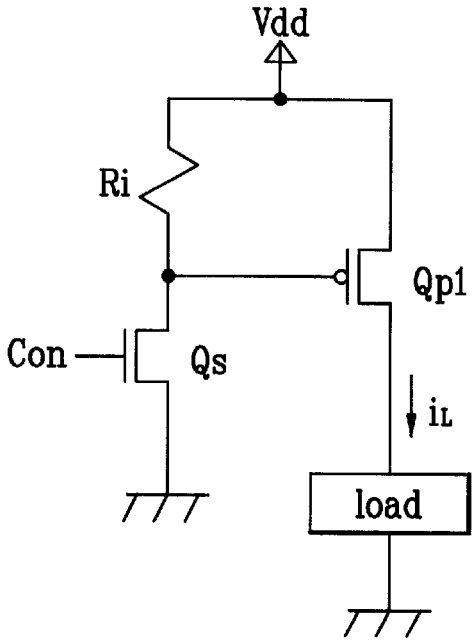
FIG.1 Related Art
FIG. 1 is a diagram illustrating a related art passive type current control circuit.
Figure 2:
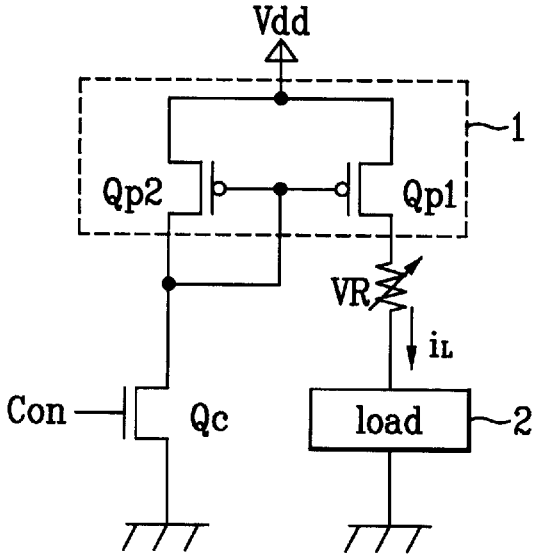
FIG.2 Related Art
FIG. 2 is a diagram illustrating another related art passive type current control circuit.
Figure 3:
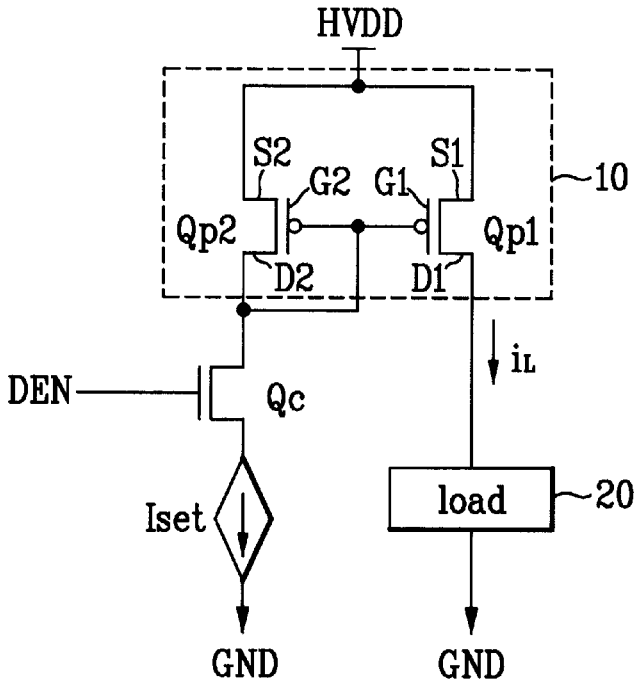
FIG. 3 is a diagram illustrating a current control circuit according to the first embodiment of the present invention.

Referring to FIG. 3, a current control circuit for a display device includes a current mirror circuit 10, a current set unit Iset, and a switching element Qc. The current mirror circuit 10 includes a first PMOS FET Qp1 and a second PMOS FET Qp2 which are high voltage electronic devices, and outputs current equivalent to a power source voltage HVDD through two output terminals.

The current set unit Iset is connected with a drain of the second PMOS FET Qp2 corresponding to one of the two output terminals and controls current iL flowing in a load 20 connected with a drain of the first PMOS FET Qp1.

Meanwhile, the switching element Qc is connected between the drain of the second PMOS FET Qp2 and the current set unit Iset, and includes a switching element for switching the operation of the current set unit Iset, i.e., turn-on operation and turn-off operation, through an external control signal DEN.

The current mirror circuit 10 includes the first PMOS FET Qp1 and the second PMOS FET Qp2. The first PMOS FET Qp1 has a first source S1 connected with the power source voltage HVDD, a first drain D1, and a first gate G1. The second PMOS FET Qp2 has a second source S2 connected with the power source voltage HVDD, a second drain D2 connected with the load 20, and a second gate G2 connected with the second drain D2 and the first gate G1.

In FIG. 3, the second drain D2 and the second gate G2 are connected with each other in the second PMOS FET Qp2 to obtain diode characteristic. Therefore, the first gate G1 and the second gate G2 are maintained at a constant voltage.

The operation of the current set unit Iset of FIG. 3 will now be described.

If an appropriate amount of current is set by the current set unit Iset, the current iL corresponding to the set amount of current flows in the load 20.

Meanwhile, when the NMOS FET Qc for switching is turned off, it is general that the high voltage devices, i.e., the first PMOS FET Qp1 and the second PMOS FET Qp2 constituting the current mirror circuit 10 are also turned off. However, as is well known, since the high voltage devices have poor turn-off characteristic, leakage current occurs in the load 20.

When the NMOS FET Qc for switching is turned on, the current iL set by the current set unit Iset uniformly flows in the load 20 in view of the characteristic of the current mirror circuit 10.

A current control circuit based on high voltage devices according to the second embodiment of the present invention will be described with reference to FIG. 4.

Figure 4:
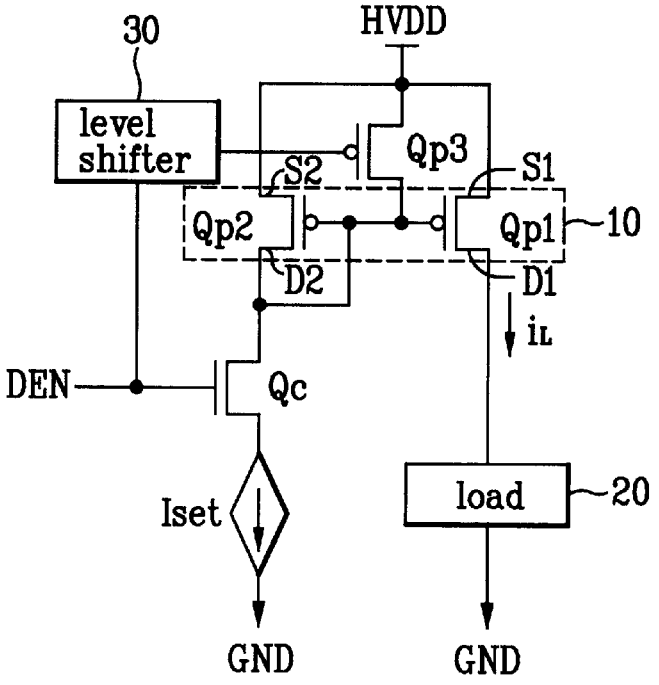
FIG. 4 is a diagram illustrating a current control circuit according to the second embodiment of the present invention.

Referring to FIG. 4, the current control circuit for a display device includes a current mirror circuit 10, a current set unit Iset, a switching element Qc, a third PMOS FET Qp3, and a level shifter 30. The third PMOS FET Qp3 acts to prevent leakage current from occurring. The level shifter 30 controls the operation of the third PMOS FET Qp3, i.e., turn-on and turn-off of the third PMOS FET Qp3.

The third PMOS FET Qp3 is connected between gates G1 and G2 of the first and second PMOS FETs Qp1 and Qp2 and a power source voltage HVDD, and is controlled by an output signal of the level shifter 30 to cut off leakage current flowing in a load 20

As described above, the third PMOS FET Qp3 is turned on or off in accordance with the output signal of the level shifter 30, and the level shifter 30 is turned on or off by an external control signal DEN of the switching element Qc, i.e., NMOS FET.

The current mirror circuit 10 includes high voltage electronic devices, i.e., the first PMOS FET Qp1 and the second PMOS FET Qp2, and outputs current equivalent to the power source voltage VDD through two output terminals, in the same manner as FIG. 3.

Meanwhile, the current set unit Iset is connected with a drain of the second PMOS FET Qp2 corresponding to one of the two output terminals and sets current iL flowing in the load 20 connected with a drain of the first PMOS FET Qp1 corresponding to the other of the two output terminals.

Meanwhile, the switching element QC is connected between the drain of the second PMOS FET Qp2 and the current set unit Iset, and switches the operation of the current set unit Iset, i.e., turn-on operation and turn-off operation, through the external control signal DEN.

The current mirror circuit 10 includes the first PMOS FED Qp1 and the second PMOS FET Qp2. The first PMOS FET Qp1 has a first source S1 connected with the power source voltage HVDD, a first drain D1 that acts as the first output terminal, and a first gate G1. The second PMOS FET Qp2 has a second source S2 connected with the power source voltage HVDD, a second drain D2 that acts as the second output terminal, and a second gate G2 connected with the second drain D2 and the first gate G1.

The second drain D2 and the second gate G2 are connected with each other in the second PMOS FET Qp2 to obtain diode characteristic. Therefore, the first gate G1 and the second gate G2 are maintained at a constant voltage.

The operation of the current set unit Iset of FIG. 4 will now be described.

If an appropriate amount of current is set by the current set unit Iset, the current iL corresponding to the set amount of current flows in the load 20.

Meanwhile, when the NMOS FET Qc for switching is turned on, the current iL set by the current set unit Iset uniformly flows in the load 20 in view of the characteristic of the current mirror circuit 10.

However, when the NMOS FET Qc for switching is turned off, leakage current may occur in the load 20 due to turn-off characteristic of the high voltage devices.

To prevent the leakage current from occurring, the third PMOS FET Qp3 is provided between the gates G1 and G2 of the high voltage devices, i.e., the first and second PMOS FETs Qp1 and Qp2 and the power source voltage HVDD. Thus, the leakage current can be prevented from flowing in the load 20.

Meanwhile, the first PMOS FET Qp1 and the second PMOS FET Qp2, the switching element Qc, i.e., NMOS FET, and the third PMOS FET are formed in an Extended-Drain MOS FET (ED MOSFET) type.

The operation of the current control circuit of FIG. 4 will be described in more detail.

First, the amount of the current iL applied to the load 20 is determined by the current set unit Iset. Once the switching element Qc, i.e., NMOS FET is turned on by the control signal DEN, the third PMOS FET Qp3 is turned off.

Meanwhile, the gates G1 and G2 of the first PMOS FET Qp1 and the second PMOS FET Qp2 constituting the current mirror circuit are always maintained at a constant voltage level due to the diode characteristic of the second PMOS FET Qp2. Accordingly, the first PMOS FET Qp1 is turned on by the constant voltage level, and the current set by the current set unit Iset flows in the load 20.

As described above, in the current control circuit according to the second embodiment of the present invention, the first PMOS FET Qp1 and the second PMOS FET Qp2 constituting the current mirror circuit have matched characteristic. When the first PMOS FET Qp1 and the second PMOS FET Qp2 are manufactured on one chip, some process change may occur and a threshold voltage and an effective channel length may be varied depending on the location of a wafer.

However, the current iL output from the first PMOS FET Qp1 to the load 20 has the same value as that set by the current set unit Iset.

Therefore, to obtain the matched characteristic, layout of the first PMOS FET Qp1 and the second PMOS FET Qp2 is very important when they are manufactured on one chips.

Figure 5:
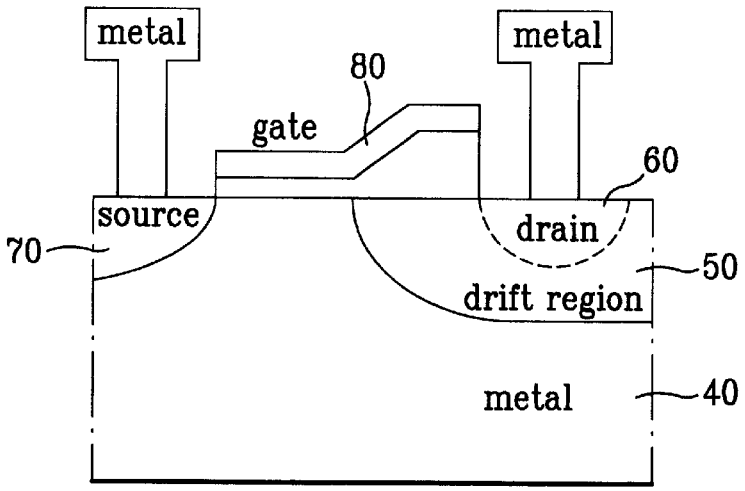
FIG. 5 is a sectional view illustrating a structure of a transistor as a high voltage device in accordance with the present invention.
Figure 6:
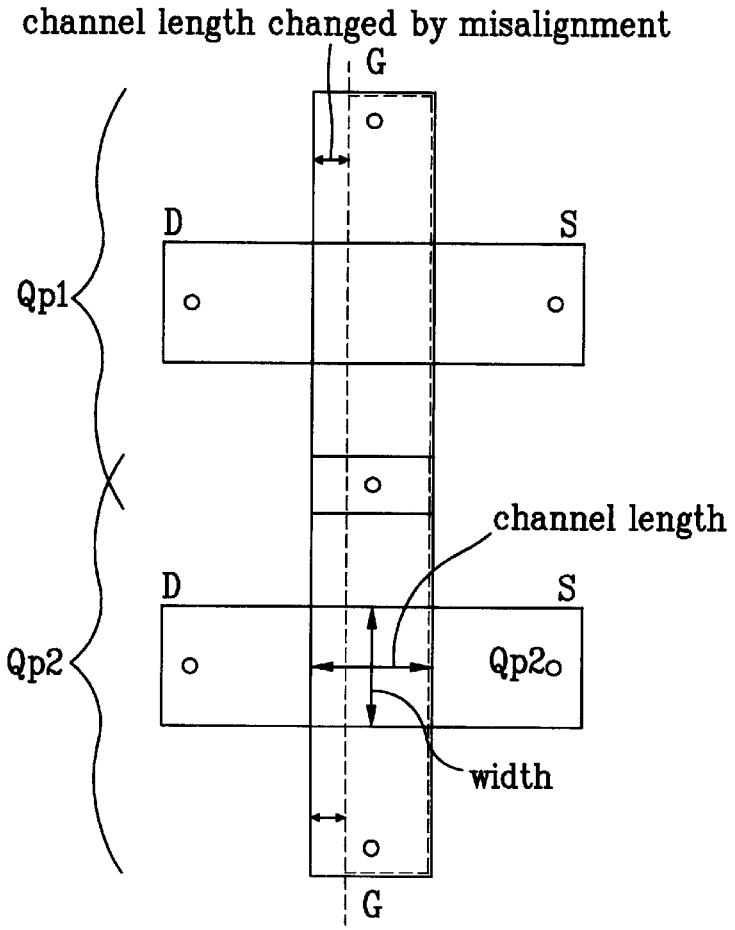
FIG. 6 is a diagram illustrating layout of two transistors having a mirror type in accordance with the present invention.

FIG. 5 is a sectional view illustrating a structure of a high voltage device, i.e., PMOS FET in accordance with the present invention, and FIG. 6 is a diagram illustrating layout of two MOS FETs having a mirror type in accordance with the present invention.

Referring to FIG. 5, a drain region 60 is longer than a source region 70. The drain region 60 has a drift region 20 with a smaller density than an ion injection density of the source region 70 to resist a high voltage applied thereto.

In other words, the MOS FET of FIG. 5 has an asymmetrical structure not a soft alignment structure. Accordingly, the drain region 60 may be longer or shorter due to misalignment of a mask during the process of manufacturing the MOS FETs on a wafer. In this case, the effective channel lengths of the MOS FETs are varied and voltage-current characteristic of the MOS FETs is also varied.

Therefore, it is very important that the first PMOS FET Qp1 and the second PMOS FET Qp2 have matched characteristic.

As shown in FIG. 6, it is necessary to form layout of the current mirror circuit in order that the drain regions D1 and D2 of the PMOS FETs Qp1 and Qp2 are arranged in parallel to, thereby obtaining the matched characteristic of the PMOS FETs.

Thus, the effective channel lengths of the MOS FETs are varied at the same size as each other by misalignment of the mask during the process of manufacturing the current mirror circuit. Accordingly, there is no change of the voltage-current characteristic of the MOS FETs according to change of the effective channel lengths.

Meanwhile, the effective channel length is proportional to the amount of current flowing in the channel while a channel width is inversely proportional to the amount of current flowing in the channel.

For example, in a state where the channel length ratio of the first PMOS FET Qp1 and the second PMOS Qp2 is 1:1, the channel width ratio of them is 1/N:1. Alternatively, in a state where the channel width ratio of the first PMOS FET Qp1 and the second PMOS Qp2 is alike, the channel length ratio of them is 1.1/N. In this case, power consumption of the current control circuit can remarkably be reduced as compared with that the channel length ratio and the channel width ratio of the first PMOS FET Qp1 and the second PMOS FET Qp2 are all 1:1.

As aforementioned, the current control circuit based on high voltage devices according to the present invention has the following advantages.

First, since the transistors constituting the current mirror circuit have matched characteristic, the current flowing in the load can be set to be equivalent to the current set by the current control circuit even if the threshold voltage and the effective channel length are varied depending on the process change and the location of the wafer during the manufacturing process of the chip.

Since the channel length or the channel width of the high voltage devices constituting the current mirror circuit is controlled, power consumption of the current control circuit can remarkably be reduced.

Furthermore, it is possible to accurately control the current flowing in the load considering the nonlinear characteristic of the high voltage devices.

Finally, the effective channel lengths of the high voltage devices are varied at the same size as each other by misalignment of the mask during the process of manufacturing the current mirror circuit. Accordingly, the voltage-current characteristic of the current control circuit is not varied.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A current control circuit for display device of passive matrix type comprising:

a current mirror circuit consisted of high voltage electronic devices, for outputting current equivalent to a power source voltage to a load;

a current set unit connected with the current mirror circuit, for setting a value of the current flowing in the load; and a switching element connected between the current mirror circuit and the current set unit, for switching the operation of the current set unit through an external control signal, wherein the current set unit is connected between the switching element and a ground voltage.

2. The current control circuit of claim 1, wherein the high voltage devices constituting the current mirror circuit have at least one controlled ratio of a channel length ratio and a channel width ratio between them.

3. The current control circuit of claim 1, wherein the high voltage devices constituting the current mirror circuit include two PMOS FETs, a first PMOS FET of the two PMOS FETs including a first source connected with a power source voltage, a first drain connected with the load, and a first gate connected with the first drain to implement a diode function, and a second PMOS FET of the two PMOS FETs including a second source connected with the power source voltage together with the first source, a second drain connected with the switching element, and a second gate directly connected to the first gate.

4. The current control circuit of claim 3, wherein the first PMOS FET and the second PMOS FET are Extended-Drain MOS FETs (ED-MOS FETs).

5. The current control circuit of claim 3, wherein the first PMOS FET and the second PMOS FET have drain regions arranged in parallel to have matched characteristic.

6. The current control circuit of claim 3, wherein the first PMOS FET and the second PMOS FET have a channel length ratio of 1:1 and a channel width ratio of 1/N:1.

7. The current control circuit of claim 3, wherein the first PMOS FET and the second PMOS FET have a channel width ratio of 1:1 and a channel length ratio of 1:1/N.

8. The current control circuit of claim 1, wherein the switching element is an NMOS FET.

9. The current control circuit of claim 8, wherein the NMOS FET is ED-MOS FET.

10. The current control circuit of claim 1, wherein the current mirror circuit is fixed and consists of two transistors.

11. A passive matrix display current control circuit comprising:

a current mirror circuit consisted of high voltage electronic devices, for outputting current equivalent to a power source voltage to a load;

a current set unit connected with the current mirror circuit, for setting a value of the current flowing in the load;

a first switching element connected between the current mirror circuit and the current set unit, for switching the operation of the current set unit through an external control signal;

an element for preventing leakage connected between the power source voltage and the current mirror circuit, for preventing leakage current from occurring in the load; and a second switching element for switching the element for preventing leakage through the external control signal, wherein the high voltage devices constituting the current mirror circuit include two PMOS FETs, a first PMOS FET of the two PMOS FETs including a first source connected with a power source voltage, a first drain connected with the load, and a first gate connected with the first drain to implement a diode function, and a second PMOS FET of the two PMOS FETs including a second source connected with the power source voltage together with the first source, a second drain connected with the first switching element, and a second gate continuously directly connected to the first gate.

12. The current control circuit of claim 11, wherein the high voltage devices constituting the current mirror circuit have at least one controlled ratio of a channel length ratio and a channel width ratio between them.

13. The current control circuit of claim 11, wherein the first PMOS FET and the second PMOS FET are ED-MOS FETs.

14. The current control circuit of claim 11, wherein the first PMOS FET and the second PMOS FET have drain regions arranged in parallel to have matched characteristic.

15. The current control circuit of claim 11, wherein the first PMOS FET and the second PMOS FET have a channel length ratio of 1:1 and a channel width ratio of 1/N:1.

16. The current control circuit of claim 11, wherein the first PMOS FET and the second PMOS FET have a channel width ratio of 1:1 and a channel length ratio of 1:1/N.

17. The current control circuit of claim 11, wherein the first and second switching elements are NMOS FETs.

18. The current control circuit of claim 17, wherein the NMOS FETs are ED-MOS FETs.

19. The current control circuit of claim 11, wherein the element for preventing leakage is a third PMOS FET, and the second switching element is a level shifter for switching the element for preventing leakage through the external control signal for the first switching element.

20. A current control circuit for display device of passive matrix type, comprising:

a current mirror circuit that includes high voltage electronic devices that output current equivalent to a first reference voltage to a load;

a current set circuit coupled to the current mirror circuit that sets a value of the current flowing in the load; and a switching circuit coupled between the current mirror circuit and the current set circuit that switches operation of the current set unit through a control signal, wherein the current set circuit is connected between the switching circuit and a second reference voltage, wherein the second reference voltage is less than the first reference voltage.

21. The current control circuit of claim 20, comprising:

an element for preventing leakage connected between the first reference voltage being a power source voltage and the current mirror circuit, for preventing leakage current from occurring in the load; and a second switching element for switching the element for preventing leakage through the control signal, wherein the second reference voltage is ground.

22. The current control circuit of claim 20, wherein the current mirror circuit consists of two transistors, wherein the current mirror circuit is fixed, and wherein the switching circuit enables and disables the current mirror.

23. The current control circuit of claim 20, wherein the value of a current flowing in the load is set by the current control circuit of said passive matrix type without a capacitor.

* * * * *